US009657947B2

(12) United States Patent
Cook et al.

(10) Patent No.: US 9,657,947 B2
(45) Date of Patent: May 23, 2017

(54) OPEN SOLENOID VALVE WITH ARC RELIGHTER, METHOD TO AUGMENT FLAME SAFEGUARD

(71) Applicant: Total Energy Resources, Inc., Sand Spring, OK (US)

(72) Inventors: Scott Cook, Broken Arrow, OK (US); Jose Pereira, Jenks, OK (US)

(73) Assignee: Oil, Gas and Industrial Process Equipment, Inc., Sand Spring, OK (US)

( * ) Notice: Subject to any disclaimer, the term of this patent is extended or adjusted under 35 U.S.C. 154(b) by 383 days.

(21) Appl. No.: 14/216,355

(22) Filed: Mar. 17, 2014

(65) Prior Publication Data

US 2014/0315138 A1 Oct. 23, 2014

Related U.S. Application Data

(60) Provisional application No. 61/794,387, filed on Mar. 15, 2013.

(51) Int. Cl.
*F23N 5/08* (2006.01)
*F23Q 9/14* (2006.01)
*F23N 5/24* (2006.01)

(52) U.S. Cl.
CPC ..... *F23Q 9/14* (2013.01); *F23N 5/085* (2013.01); *F23N 5/245* (2013.01)

(58) Field of Classification Search
CPC ..... F23N 5/082
USPC ..... 431/51, 54
See application file for complete search history.

(56) References Cited

U.S. PATENT DOCUMENTS 1,713,156 A * 5/1929 Winter ..... H02P 23/16 318/478
2,637,390 A * 5/1953 Perl ..... F23N 5/105 431/46
2,746,530 A * 5/1956 Young ..... F23D 5/00 431/285
2,967,021 A * 1/1961 Swenson ..... F23N 5/067 122/447
3,480,029 A * 11/1969 Saxon ..... F16K 31/143 137/625.18
3,975,135 A * 8/1976 Kinsella ..... F23N 5/027 137/65
4,288,978 A * 9/1981 Wyatt ..... F22B 1/26 431/281
4,382,770 A * 5/1983 Pinckaers ..... F23N 5/123 431/18
5,347,982 A * 9/1994 Binzer ..... F23N 5/123 126/503
5,924,857 A * 7/1999 Frasnetti ..... F23N 5/203 126/39 BA
2001/0042564 A1* 11/2001 Abraham ..... F23D 14/26 137/65
2006/0183068 A1* 8/2006 Wrona ..... F23D 14/34 431/354

* cited by examiner

*Primary Examiner* — Avinash Savani
(74) *Attorney, Agent, or Firm* — Cherskov Flaynik & Gurda, LLC

(57) ABSTRACT

The invention provides a pilot light ignition system comprising a solenoid valve and a flame safeguard controller. Also provided is a pilot light ignition process comprising a normally open solenoid valve that shuts down a main burner gas supply while the pilot is being lit. A fail last position solenoid can also be utilized with the system.

13 Claims, 5 Drawing Sheets

CONTROL PANEL ASSEMBLY

| ITEM | QTY | PART NAME | RAW PART DESCRIPTION | PART NUMBER | UNIT SIZE | UNIT QTY | UNITS |
|---|---|---|---|---|---|---|---|
| 1 | 1 | CONTROL PANEL | ENCLOSURE, 16" X 14" X 8" | 450196 | | 1 | EA |
| 2 | 1 | BACK PANEL | ENCLOSURE BACK PANEL | 450197 | | 1 | EA |
| 3 | 1 | PILOT IGNITION | IGNITION CONTROL MODULE | 450195 | | 1 | EA |
| 4 | 1 | CHARGER | SOLAR BATTERY CHARGER SX6 | 450224 | | 1 | EA |
| 5 | 3 | TERMINAL BLOCK | TERM BLOCK SOCKET | Q247148 | | 1 | EA |
| 6 | 1 | TERMINAL BLOCK | TERM BLOCK CIRCUIT BREAKER 3A | | | 1 | EA |
| 7 | 1 | TERMINAL BLOCK | TERM BLOCK CIRCUIT BREAKER 1A | | | 1 | EA |
| 8 | 1 | RELAY | SOLID STATE RELAY 12VDC COIL | Q247149 | | 1 | EA |
| 9 | 1 | DIN RAIL | DIN RAIL 35 MM | Q245736 | | 1 | EA |
| 10 | 11 | TERMINAL BLOCK | TERMINAL BLOCK 10A 4 MM | Q248742 | | 1 | EA |
| 11 | 1 | BATTERY | SEALED BATTERY, 12 VDC 18 AH/HR | 450223 | | 1 | EA |
| 12 | 1 | DOOR LABEL | CUSTOM TERI LABEL | | | 1 | EA |

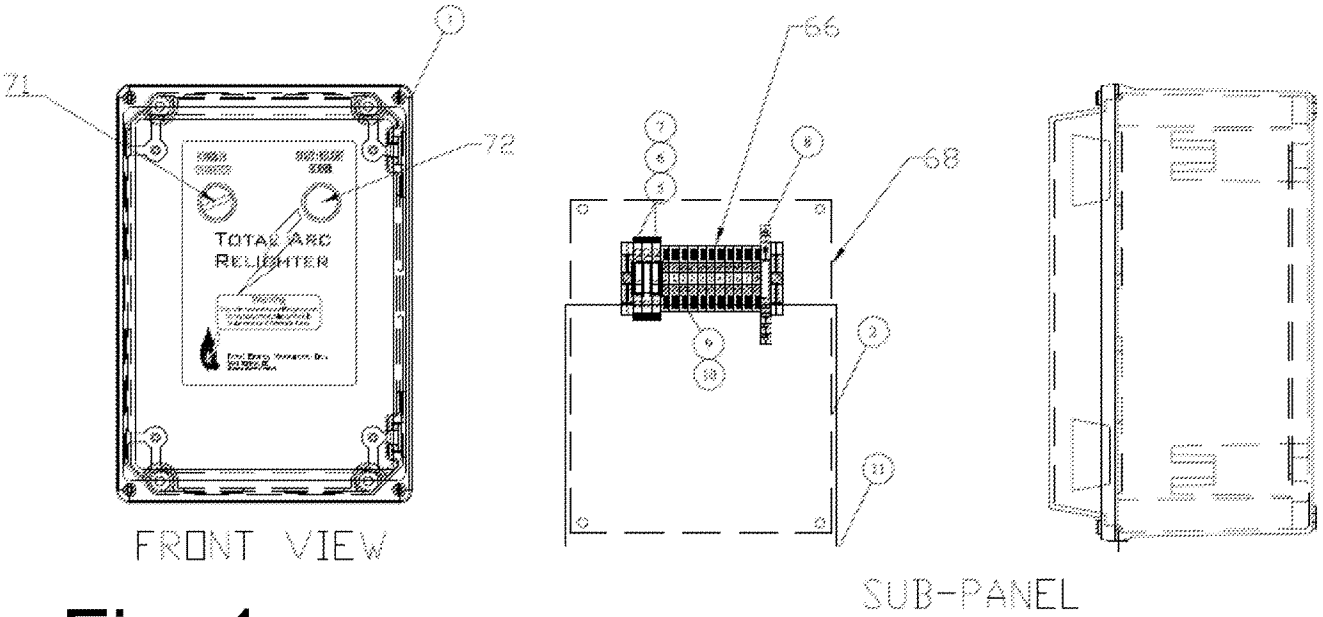

Fig. 1

CONTROL PANEL ASSEMBLY

| ITEM | QTY | PART NAME | RAW PART DESCRIPTION | PART NUMBER | UNIT SIZE | UNIT QTY | UNITS |
|---|---|---|---|---|---|---|---|
| 1 | 1 | CONTROL PANEL | ENCLOSURE, 16" X 14" X 8" | 450196 | | 1 | EA |
| 2 | 1 | BACK PANEL | ENCLOSURE BACK PANEL | 450197 | | 1 | EA |
| 3 | 1 | PILOT IGNITION | IGNITION CONTROL MODULE | 450195 | | 1 | EA |
| 4 | 1 | CHARGER | SOLAR BATTERY CHARGER SK6 | 450224 | | 1 | EA |
| 5 | 3 | TERMINAL BLOCK | TERM BLOCK SOCKET | Q247148 | | 1 | EA |
| 6 | 1 | TERMINAL BLOCK | TERM BLOCK CIRCUIT BREAKER 3A | | | 1 | EA |
| 7 | 1 | TERMINAL BLOCK | TERM BLOCK CIRCUIT BREAKER 1A | | | 1 | EA |
| 8 | 1 | RELAY | SOLID STATE RELAY 12VDC COIL | Q247149 | | 1 | EA |
| 9 | 1 | DIN RAIL | DIN RAIL 35 MM | Q245736 | | 1 | EA |
| 10 | 11 | TERMINAL BLOCK | TERMINAL BLOCK 10A 4 MM | Q248742 | | 1 | EA |
| 11 | 1 | BATTERY | SEALED BATTERY, 12 VDC 18 AH/HR | 450223 | | 1 | EA |
| 12 | 1 | DOOR LABEL | CUSTOM TERI LABEL | | | 1 | EA |

| Fig. 2a | Fig. 2b |
|---|---|

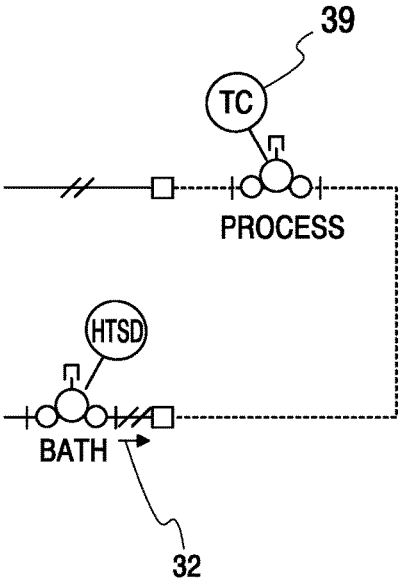
| | |
|---|---|
| | BALL VALVE |
| | BURNER |
| | FLOW METER |
| | STRAINER |
| | LEVEL FLOAT |
| | NEEDLE VALVE |
| | PILOT |
| | PRESSURE CONTROL VALVE |
| | PRESSURE INDICATOR |
| | PRESSURE RELIEF VALVE |
| | NORMALLY OPEN SOLENOID VALVE |
| | SPEED CONTROL VALVE |
| | TEMPERATURE CONTROLLER |
| | TEMPERATURE CONTROL VALVE |
| | FLAME SAFE GUARD (FSG) |
| | ELECTRIC |
| | CONTROL TUBING |
| | MAIN PIPING |
| | CUSTOMER LINE |
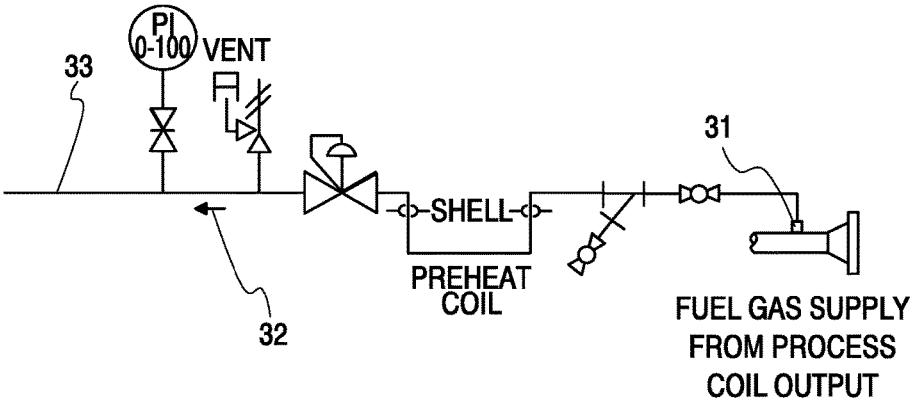
Fig. 3b
Fig. 3
| Fig. 3a | Fig. 3b |
|---|---|

OPEN SOLENOID VALVE WITH ARC RELIGHTER, METHOD TO AUGMENT FLAME SAFEGUARD

PRIORITY

This utility application claims the benefits of U.S. Provisional Patent Application No. 61/794,387, filed on Mar. 15, 2013, the entirety of which is incorporated herein by reference.

BACKGROUND OF THE INVENTION

1. Field of the Invention

This invention relates to a device and method to augment flame safeguards for heating systems, and more specifically, this invention combines a solenoid valve with an independent flame safe guard system to optimize the safety of pilot light systems.

2. Background of the Invention

In the event that a pilot flame goes out, often there is a lag time between loss of pilot and the time when the main burner valves close off fuel flow. This lag time causes fuel gas being dumped into the fire tube of the furnace or burner venue. An explosion or backfire hazard develops, such as can occur during pilot relighting.

Solutions to this problem have included replacing the independent flame safe guard (FSG) with a solenoid valve. The valve either fails closed or fails in its last position, which can be either open or closed. Fail closed solenoids require continuous energy to keep them open for the heater to operate. Systems operating "off the power grid" or separate from the power distribution system ("primary energy sources"), require sizable investments to provide this continuous energy in the form of batteries and/or solar panels ("secondary energy sources").

In situations where fail last position solenoids are utilized, fail open scenarios occur when there is a loss of power from the secondary energy sources, resulting in explosion hazards.

A need exists in the art for a pilot light configuration that eliminates explosion hazards. The configuration should minimize the amount of energy required to function so as to eliminate the need for expensive secondary energy sources.

SUMMARY OF INVENTION

An object of the invention is to provide a method and a system for a safe and efficient pilot light configuration that overcomes many of the drawbacks of the prior art. A primary object of the invention is to provide a redundant safety system that includes a solenoid valve that ultimately closes a main valve supplying fuel gas to a main burner, and a flame safeguard component that ultimately closes to shut down fuel gas flow to a pilot light.

Another object of the present invention is to provide an energy efficient and safe pilot light system. A feature of the invention is a combination of a solenoid valve and a flame safe guard mechanism. An advantage of the invention is that it prevents fuel from entering the fire tubes of a furnace or boiler via the main burner when the pilot light is not on or otherwise lit.

Briefly, the invention provides a pilot light ignition system incorporating a solenoid valve as a means to cut off fuel flow to the main burner by closing the main valve while a pilot system is being relit; the main valve remaining closed while a pneumatic flame safeguard is in the process of shutting down the gas supply line to the pilot light.

Also provided is a pilot light ignition process comprising a normally open solenoid valve that maintains closed the main valve to shut down a main burner gas supply while the pilot is being lit. (Normally open (NO) solenoid valves close when energized and open when DE-energized.)

The invention further provides a pilot light ignition system comprising a fail last position solenoid valve that shuts down the main valve when the pilot light ignition system ignites the pilot, the solenoid valve reopening the main valve with the presence of a pilot flame.

Further provided is a pilot light ignition system comprising a fail last position solenoid valve that shuts down the main valve when the pilot light system is being lit, the solenoid valve reopens the main valve after a predetermined solenoid valve shut down time has been satisfied, and the pilot light has been lit.

Also provided is a pilot light ignition process comprising a normally open solenoid value that closes a main valve that cooperatively shuts down a main burner gas supply while the pilot light ignition process is lighting the pilot.

The invention also provides a pilot light ignition system comprising: means for igniting a pilot light when predetermined conditions are satisfied; means for igniting a main burner when predetermined pilot light conditions are satisfied; means for shutting down pilot and main fuel gas systems when pilot light conditions are not satisfied; and means for re-starting pilot light and main fuel gas supply systems when predetermined conditions are satisfied.

BRIEF DESCRIPTION OF DRAWING

The invention together with the above and other objects and advantages will be best understood from the following detailed description of the preferred embodiment of the invention shown in the accompanying drawings, wherein:

FIG. 1 is a wiring diagram of a portion of the invented system that includes a solenoid valve that ultimately closes a main valve supplying fuel gas to a main burner in accordance with features the present invention.

FIG. 3*a* and FIG. 3*b* depict a process and instrument schematic ("P and I") diagram for controlling pilot and main fuel gas flows to an indirect gas fired heater, in accordance with features of the present invention.

DETAILED DESCRIPTION OF THE INVENTION

Figure 2A:
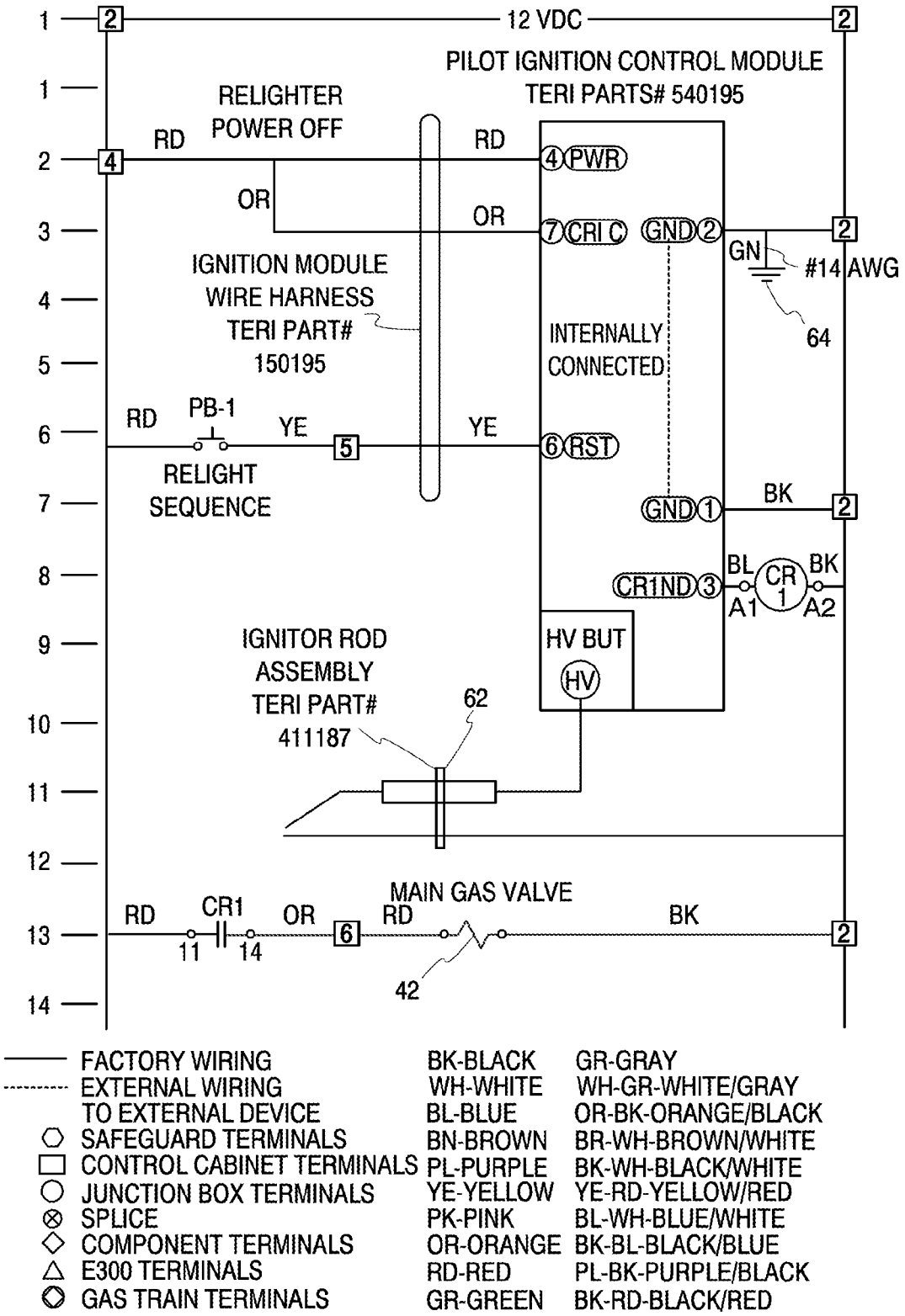
FIG. 2*a* and FIG. 2*b* depict a wiring diagram of an exemplary control panel for use with the invented relighter module control system, in accordance with features of the present invention.

The foregoing summary, as well as the following detailed description of certain embodiments of the present invention, will be better understood when read in conjunction with the appended drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention introduces the control of a solenoid valve 42 for a fuel gas main valve 46 by a pilot gas lighting system 30, the solenoid valve 42 allowing the opening of or causing the closing of the main valve 46. The solenoid valve 42 is operated by a Total-Arc relighter system (TA) 60. The TA 60 monitors the pilot flame independently of a flame safe guard (FSG) 34 and operates the solenoid valve 42 in cooperation with the FSG 34.

The invented relighter control system comprises a relighting module with the added safety feature of a normally open solenoid valve 42. The solenoid valve 42 closes the main valve 46 which shuts down the main burner gas supply line 33 while the system is lighting the pilot 36. The pneumatic flame safeguard (Item #34) shuts down both the pilot light AND the main burner. As such, this system complements the pneumatic flame safeguard controller 34 to add extra safety features.

The device looks for the presence of a flame. If a flame is present, the solenoid 42 stays open. (In absence of flame, the system commands the solenoid 42 to close.) In an embodiment of the invention, the solenoid 42 fails last in a closed position. Alternatively, once a flame is detected, a fail last position solenoid 42 is commanded to open.

Commissioning and Start Up Detail

After installation of the invented relighter module system to the existing heater, the following steps are followed to commission the system.

1. The invented relighter module (42 and 60) is to be incorporated with the existing furnace, boiler, via the wiring diagram depicted in FIG. 1 and the P and I diagram depicted in FIG. 3.

2. Upon wiring and checking the accuracy of same, the user closes all manual valves to the pilot and main burner gas supply.

3. In an embodiment of the invention, the user assures that the space between the pilot orifice (not depicted) and ignitor rod 62 is approximately ⅛". This distance can vary from about ⅛" to as much as about ¾" depending on the hardware utilized.

Figures 2, 2B:
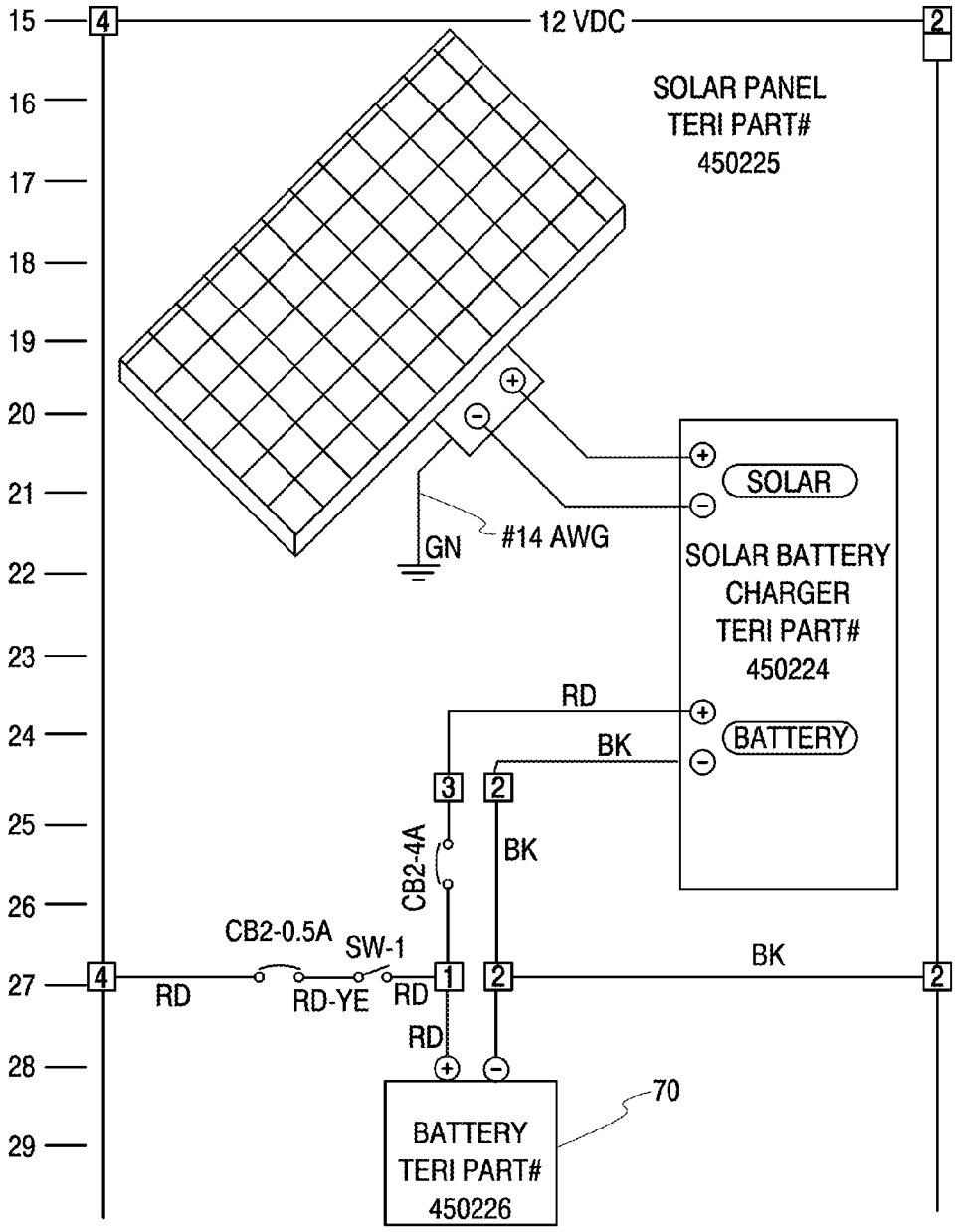

4. The user confirms that ground continuity exists between the panel ground 64 and ignitor assembly. FIG. 2*a* and FIG. 2*b* depict the panel wiring. The grounding is part of the terminal block 66, which is grounded to the panel 68. The panel 68 is grounded to the heater or heater skid. Preferably, the panel is grounded to whichever unit comprises the larger grounding mass.

5. The user then follows the heater manufacturer's procedures to vent any fumes left on fire tube assembly.

6. The battery 70 is installed and checked for proper voltage. In an embodiment of the invention, the battery is a 12 volt D.C.

7. The user turns the power ON to the total arc relighter system 60 and presses the START/RELIGHT button. The user immediately checks for the presence of a spark on the ignitor rod 62.

8. Once spark has been confirmed, power is turned OFF via a switch 71 and the user prepares the heater per heater manufacturer's instructions, for initial start up.

9. Once the heater is ready to start, the user turns the power knob 71 to the ON position and push the START/RELIGHT pushbutton 72. The user engages the pneumatic flame safeguard 34 immediately prior or immediately after pushing start/relight pushbutton 72.

10. First time lighting might require several tries to purge air from the main and pilot gas lines 33 and 37.

Operation Detail

In operation, when the unit is turned ON, the controller will wait for a START/RELIGHT instruction (not depicted). Once the proper start up procedure is followed for the heater on which the relighter module is installed, the user presses the START/RELIGHT button 72. This starts the lighting procedure in which the module simultaneously closes the main valve 46 for fuel gas and starts to spark the ignitor 62 assembly. The lighting process has a duration of approximately 15 seconds during which the module continues to spark until a pilot flame is detected. Once a pilot flame is detected, the sparking of the ignitor rod 62 stops and the main gas valve 46 opens.

If a pilot flame is not detected after 15 seconds of sparking, the relighter module 60 will go into a lockout mode during which it will hold the main gas valve 46 closed for two minutes. This allows the pneumatic flame safeguard 34 to cool down enough to shut down the gas supply to the pilot 36 and the main burner 38.

After the two minute period, the main gas solenoid valve 42 will open again and the system will stay in a lockout mode that will require a START/RELIGHT instruction. The user must manually actuate the start/relight button 72. In an embodiment of the invention, Synetek Inc. (Wellington, Colo.) relighting modules and associated software were modified to include a time out feature to lock out the system if a flame was not detected within a predetermined lighter period (e.g., 15 seconds).

Example 1

An embodiment of the invention comprises either a Fail Open or Fail Last Position 3/2 solenoid valve 42. (A 3/2 solenoid value is a directional control value with three ways, three ports, and two positions.) Other solenoid valve types, such as 2/2 and 4/2 and 4/3 valves, are also suitable. 2/2 valves are direction control valves with two ways, two ports and two positions. 4/2 valves comprise four ways, four ports and two positions. 4/3 valves comprise four ways, four ports and three positions. Solenoid valves are available commercially, such as the ASCO® RedHat general service solenoid valve 3/2 series 8320. Asco is a subsidiary of Emerson Inc. of St. Louis, Mo.

The solenoid works in conjunction with the Total Arc ("TA") relighter system 60. The TA 60 as designed monitors the pilot with the FSG 34 and uses a timer to determine when to open the solenoid valve 42 after pilot 36 failure.

An Independent FSG 34 operates in conjunction with the solenoid 42 and relighter system 60. Exemplary FSGs 34, which operate independently of an external electrical power supply are commercially available such as Johnson Controls H19 BASO pilot valve. Johnson Controls is located in Milwaukee Wis. The FSG 34 operates as designed such as using the heat of the flame to signal when to open or close. The re-lighter 60, however, immediately sends two signals upon pilot 36 failure: (1) A signal is sent to call for relight and (2) a signal is sent for the solenoid valve 42 to close.

Figure 3A:
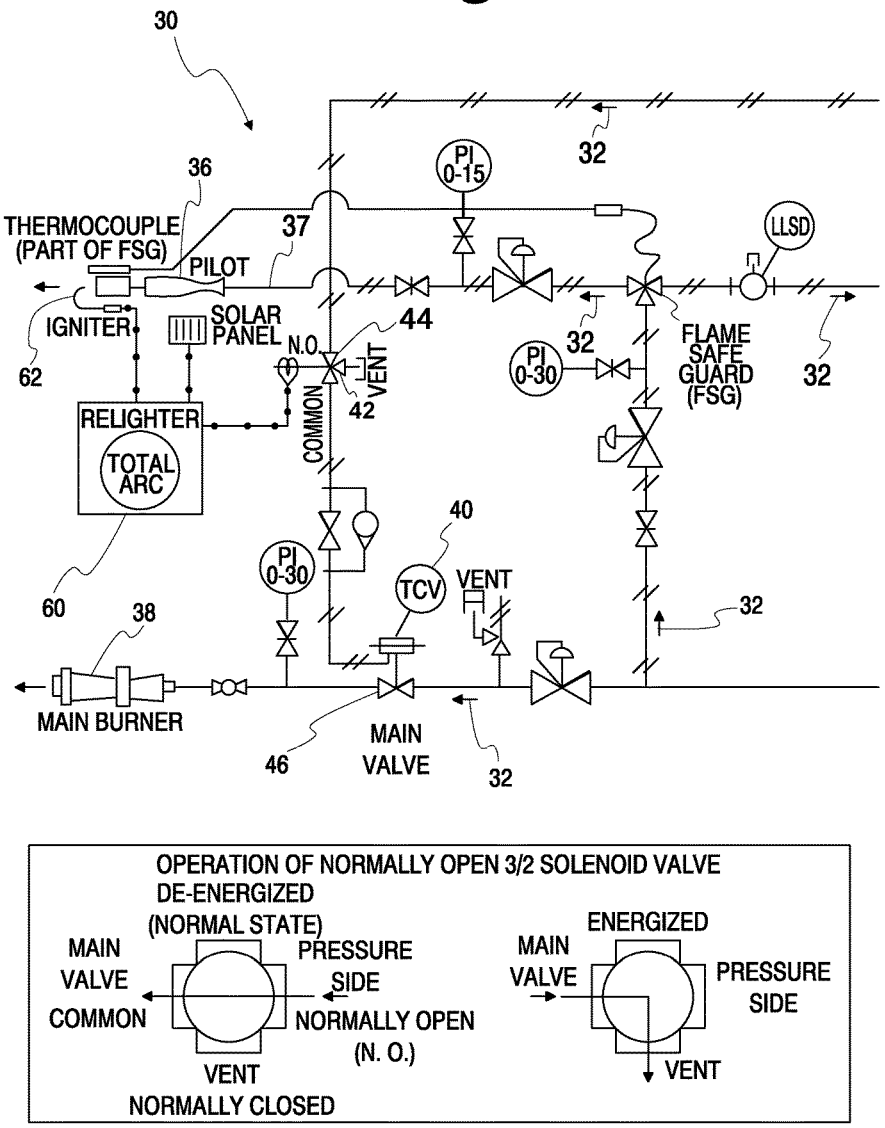

FIG. 3*a* and FIG. 3*b* are a P and I schematic diagram that includes the invented system juxtaposed with a commercial FSG 34. The system is designated as numeral 30 in the figure. The arrows 32 in the figure indicate the direction of flow of the fuel from the fuel supply 31 and through the fuel lines 33 and 37. (The fuel is supplied in either liquid or gas phase.) The double slash lines in the drawing indicate control tubing.

The flame safe guard 34 is normally closed during operation of the system. When the flame safe guard 34 is open, gas is allowed to travel to the pilot light orifice 36 for lighting of the pilot. After the pilot light is lit, and if pressure is detected in the fuel gas line 33, a temperature controller 39 causes an actuator portion 40 of the main valve 46 to forcibly open the main valve 46 thereby directing fuel gas to the main burner 38. Subsequently, the fuel gas flowing through the main burner 38 is ultimately ignited by the pilot flame.

If at anytime a loss of the pilot light occurs, a normally open solenoid valve 42 closes, resulting in the main valve 46 closing. (Loss of pilot light is often caused by the main burner 38 opening up too quickly and causing a drop in pressure to the pilot light, resulting in its extinguishment.) In instances of pilot loss and after the solenoid closes 42, the fuel in the control tubing line between the solenoid valve 42 and the main valve 46 is vented out of the system (perhaps to the atmosphere) via a vent portion 44 of the solenoid valve 42.

In the embodiment wherein the Total Arc relighter module 60 is utilized, the pilot 36 operates continuously. However, a normally open solenoid valve 42 can be used with an intermittent pilot.

In summary, the inventive feature of using a solenoid valve 42 with an Independent FSG 34 is as follows:

1. Energy is only required for the brief time the FSG 34 is cooling down. A timer cuts power to the solenoid valve 42 after sufficient time has elapsed for the Independent FSG 34 to shut down the heater. Therefore, the power requirements are substantially less than a system that uses Fail Close solenoid valves.

2. This system is substantially safer than a system using a Fail Last Position solenoid valve as a FSG 34 because this Invention supplements the Independent FSG 34 instead of replacing it. In the event of a power loss, the Independent FSG 34 will operate normally. If the system detects a loss of pilot flame, then that will signal opening of the fail last position valve or provide current to the normally open solenoid 42.

The invention increases safety, reduces cost and can be used independently of an external power source.

Example 2

Beta testing of the device in operation has yielded good results. An existing retrofit of a heater using the Total Arc relighter 60 is located at the Iron Mountain Gate Station for DTE Energy (Customer). This heater is a TERI unit which was sold in September 2009. It is 48-inches wide by 19 ft long, has a process duty of approximately 1.7 MMBtu/hr and uses a pneumatic BASO flame safeguard (FSG). The previous installed relighter was a Guardian. The Customer had repeated reliability issues with the Guardian. TERI used this opportunity to replace the Guardian with a Total Arc relighting system.

Retrofit Details

The first Total Arc system 60 was installed in place of an existing Guardian relighter system. To accommodate an easier installation TERI provided an adapter plate that would mount in the place of the actual Guardian panel mount pattern and would also accommodate the panel mount pattern of the Total-Arc enclosure with minimum labor. Once the enclosure was installed with the hardware provided the conduit connections were made using the existing conduit fittings and cable. All wiring was hooked up following FIG. 1 wiring schematic. Once the system was hooked up, the startup procedure was used to start the Total Arc system 60.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A continuous pilot light ignition system incorporating a means to cut off fuel flow to a main burner upon detection of an extinguished pilot light and until a pilot system is relit, said fuel flow remaining cutoff while a flame safeguard component is in the process of cutting off fuel flow to a pilot assembly and the main burner wherein said means to cut off fuel is not energized during fuel flow and requires energy only to close.

2. The system as recited in claim 1 wherein the fuel flow cut off means is a normally open solenoid valve that shuts down a main burner gas supply while a pilot is being lit, wherein said solenoid valve is not energized so as to allow the main fuel gas to flow with the presence of a pilot flame.

3. A pilot light ignition system incorporating a means to cut off fuel flow to a main burner while a pilot system is being relit, said fuel flow remaining cutoff while a flame safeguard component is in the process of cutting off fuel flow to a pilot assembly and the main burner, wherein the fuel cut off means comprises a fail last position solenoid valve that shuts down when system is being lit and opens after a predetermined time and the flame safeguard component ultimately closes to shut down fuel gas flow to a pilot light and main burner when required parameters are not satisfied.

4. A pilot light ignition system comprising:

a) a flame safe guard operably connected to a fail last position solenoid valve; and b) a pressure switch to detect if the flame safe guard is on before energizing a solenoid valve, thereby opening a main valve supplying fuel gas to a main burner, wherein the pressure switch provides a signal to de-energize a normally open solenoid valve, thereby opening a main valve for supplying fuel gas to a main burner.

5. The pilot light ignition system as recited in claim 4 wherein the flame safe guard operates in the event of a power loss.

6. A pilot light ignition system comprising:

a) a flame safe guard operably connected to a fail last position solenoid valve; and b) a pressure switch to detect if the flame safe guard is on before energizing a solenoid valve, thereby opening a main valve supplying fuel gas to a main burner, wherein if the system detects that the FSG is turned off, then that will signal opening of the fail last position solenoid valve.

7. A pilot light ignition system comprising:

a) a flame safe guard operably connected to a fail last position solenoid valve; and b) a pressure switch to detect if the flame safe guard is on before energizing a solenoid valve, thereby opening a main valve supplying fuel gas to a main burner, wherein if the pressure switch detects that the flame safe guard is turned off, then current is removed from the normally open solenoid to allow a main fuel gas valve to open.

8. The pilot light ignition system as recited in claim 4 wherein a flame safeguard component ultimately closes to shut down fuel gas flow to a pilot light and main burner when required parameters are not satisfied.

9. The system of claim 1 wherein said means to cut off fuel is actuated using 12 volts of DC power.

10. The system of claim 3 wherein said means to cut off fuel is actuated using 12 volts of DC power.

11. The system of claim 4 wherein said solenoid is actuated using 12 volts of DC power.

12. The system of claim 6 wherein said solenoid is actuated using 12 volts of DC power.

13. The system of claim 7 wherein said solenoid is actuated using 12 volts of DC power.

* * * * *